US005265286A

United States Patent [19]

Filipponi

[11] Patent Number: 5,265,286

[45] Date of Patent: Nov. 30, 1993

[54] WHIRLPOOL JET

[75] Inventor: Alberto Filipponi, Montefano, Italy

[73] Assignee: Sea di Filipponi A. & Co.-S.n.c., Italy

[21] Appl. No.: 887,366

[22] Filed: May 21, 1992

[30] Foreign Application Priority Data

May 24, 1991 [IT] Italy ..... 91A000012

[51] Int. Cl.[5] ..... E03C 1/084

[52] U.S. Cl. ..... 4/541.6; 4/541.4; 4/541.1; 239/428.5

[58] Field of Search ..... 4/541.6, 541.1, 541.2, 4/541.3, 541.4, 541.5; 239/428.5, 412, 587.4; 128/66, 204.24, 204.25, 205.24; 137/893, 895

[56] References Cited

U.S. PATENT DOCUMENTS

| | | | |
|---|---|---|---|
| 2,600,752 | 6/1952 | Gettins | 239/428.5 |
| 3,471,091 | 10/1969 | Baker | 239/428.5 |
| 4,408,721 | 10/1983 | Cohen et al. | 239/428.5 |
| 4,541,780 | 9/1985 | Moreland | 137/893 |
| 4,593,420 | 6/1986 | Tobias et al. | 4/541.4 |
| 4,671,463 | 6/1987 | Morcland et al. | 239/428.5 |
| 4,731,887 | 3/1988 | Henkin et al. | 4/541.4 |
| 4,797,958 | 1/1989 | Guzzini | 128/66 |
| 5,182,820 | 2/1993 | Marks | 4/541.6 |

FOREIGN PATENT DOCUMENTS

| | | | |
|---|---|---|---|
| 8906120 | 7/1989 | World Int. Prop. O. | 4/541.3 |

*Primary Examiner*—Henry J. Recla
*Assistant Examiner*—Charles R. Eloshway
*Attorney, Agent, or Firm*—Leonard Bloom

[57] ABSTRACT

A whirlpool jet which can be fixed to a bathtub and provided with water and air supply pipes under pressure, characterized by a valve with a central protrusion washed by the water on its external surface, opening in a centre air flow hole and pushed by a spring into a normally closed position, in contact on its external surface and that of the centre hole, respectively with the end of a pipe through which the mixture of air-water is discharged, and the end of a rod on the axis of said pipe.

15 Claims, 5 Drawing Sheets

WHIRLPOOL JET

DESCRIPTION

The invention refers to a whirlpool jet. It is common knowledge that a whirlpool system consists of a standard bathtub with jets on the sides supplied by piping including a pump which draws water from the bathtub filled from standard tap fittings, to produce a jet of water after having mixed the same with air supplied from the room. Since bathtubs with whirlpool system are also used as normal bathtubs, it is important from a hygienic point of view, for the jets to prevent infiltration of water into the piping of the system when the system is not used, as well as to ensure complete drainage of the water at the end of each whirlpool cycle, in order to prevent the formation of backwater mixed with detergents and skin fats, which may be polluting and lead to the formation of mould and bacteria which would then be recirculated.

From a functional point of view, it is important for the jet, when it penetrates the water mass, to trap the air bubbles which have been mixed in the same, because this is essential for producing the massaging and oxygenating action on the skin of the user.

All the jets designed to date do not fully meet all these requirements: in some cases, the water passes from the bathtub to the whirlpool system piping, in other cases backwater tends to form after each whirlpool cycle; moreover, because of the fact that the bubbles of mixed air are produced only in a surface layer, the jet of water can not keep the bubbles during penetration of the water mass in the bathtub.

The purpose of this invention is to design a jet for whirlpool systems which prevents water from filtering from the bathtub into the piping of the system when the same is not in use, and which creates a jet of air-water which can hold the air bubbles until they reach the skin of the user. One of the purposes of this invention is to design a jet which ensures complete drainage of the water at the end of each whirlpool cycle, in order to ensure a high level of hygiene and to make it possible to realize non standard functions, such as pushbutton jets, which may be used for therapeutic purposes.

Another purpose of this invention is to provide a jet with stable operation, without vibrations and oscillations and which permits full adjustability of the jets in all directions while being compact and easy to mount and dismount, even when replacing single components.

The objective as well as the purposes indicated are attained by means of a whirlpool jet according to the invention which can be fixed on the walls of a bathtub fitted with water and air supply pipes under pressure including a valve having a centre projection which is washed by water on its external surface and opening into a centre air flow hole, pushed by a spring into a normally closed position, said external surface being in contact with the end of a pipe for discharging a jet of air-water and being in contact on the surface of the centre hole with the end of a rod in the axis of this pipe.

The whirlpool jet according to the invention offers the following advantageous features:

a structure which can be fixed to the wall of a bathtub consisting of a pipe fitted at the bottom which connects to a supply pipe of water under pressure and a top pipe fitting communicating with an air supply pipe and directly with the atmosphere;

a body consisting of two hollow hemispherical covers connected to each other so as to allow a peripheral communication space with the exterior in the case of the cover facing the interior of the bathtub, which has a pipe for a jet of the water-air mixture having a rod on the axis, and in the case of the cover facing the exterior of the bathtub having a central space communicating to the exterior, said body being housed so that it can rotate in a section of the space within said structure in that internally it communicates at the level of the peripheral space between the covers with the water supply pipe and at the level of the main space in the cover facing the exterior of the bathtub with the air pipe;

a valve shaped according to a curved wall with the concavity turned to the exterior positioned in the cover turned towards the exterior of the bathtub so as to communicate at the level of the concave surface with the water and at the level of the convex surface, with the air; said curved wall being open at the centre with a hole which is substantially aligned with the centre space in said cover, and having a spring fitted between said cover and valve in order to push the valve into a normally closed position with the external concave surface in contact with the end of the output pipe of the jet in the cover facing the interior of the bathtub so as to stop the passage of the water, and with the internal surface of the hole in contact with the end of the rod in said pipe so as to stop the air flow.

Additional advantages and characteristics will be illustrated in the description of two preferred but not exclusive embodiments of the invention, given for purposes of illustration and not in a limiting sense in the attached drawings whereby:

Figure 1:
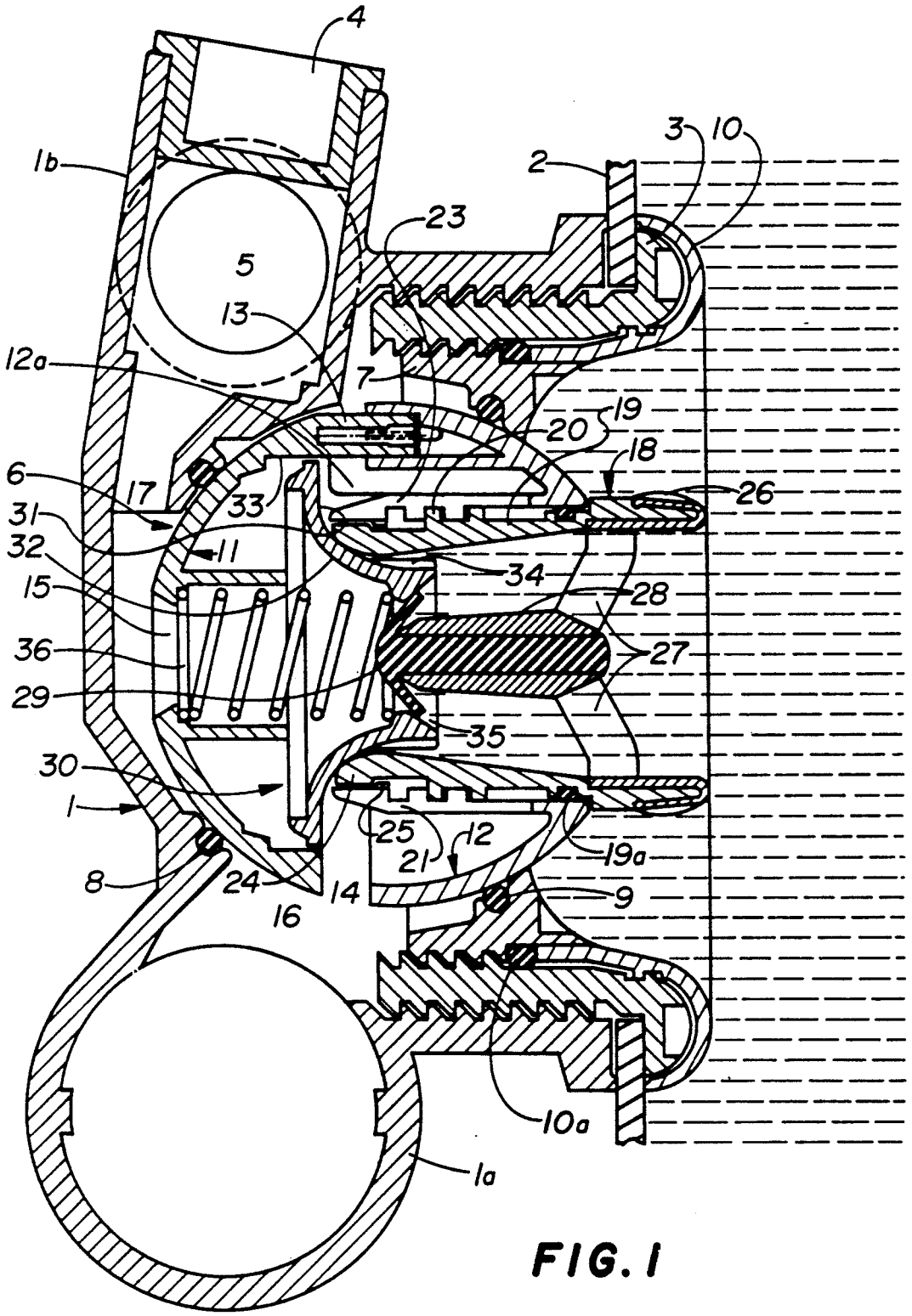
FIG. 1 is a cross-section of the invention with the whirlpool not in operation.
Figure 2:
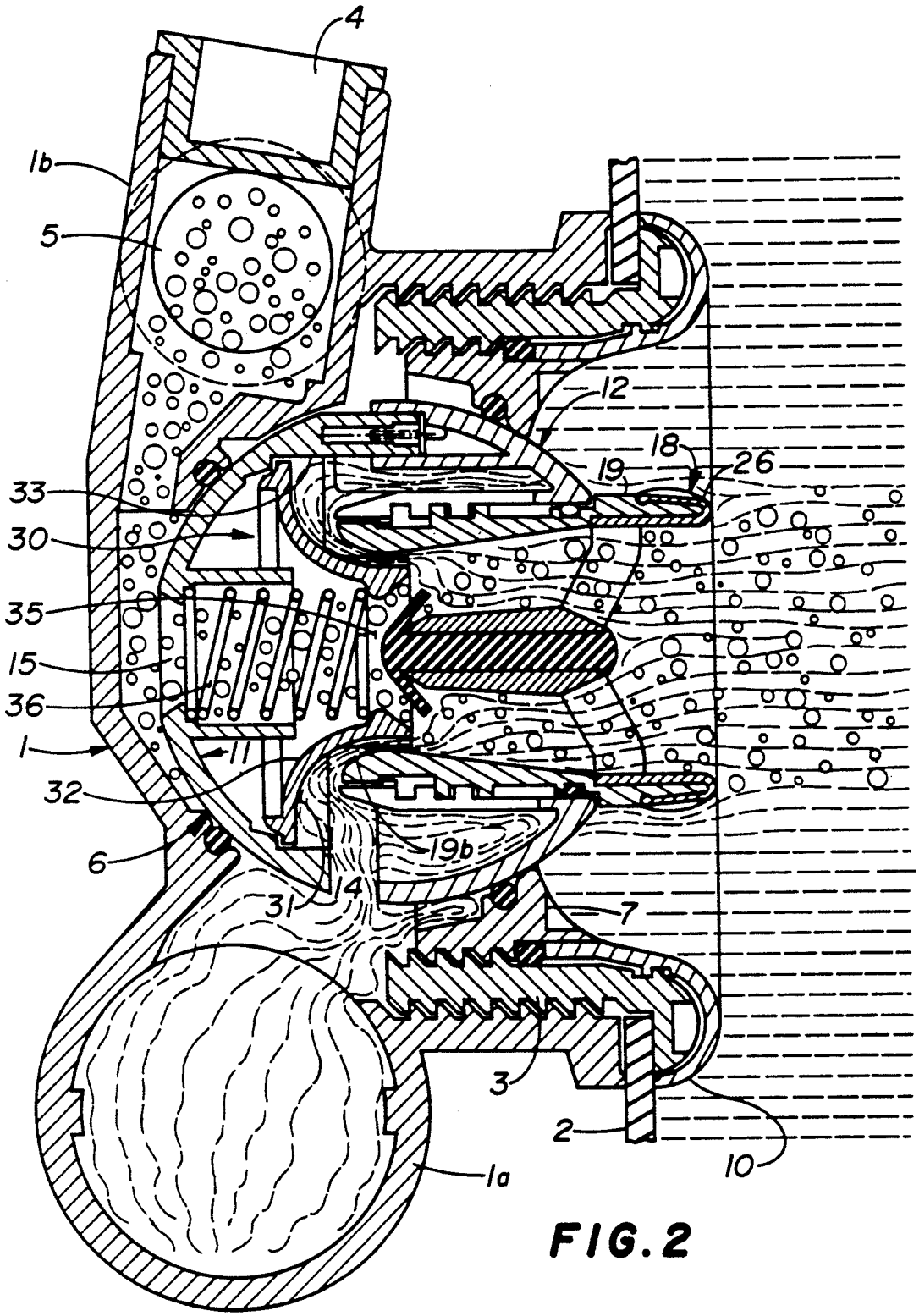
FIG. 2 is a cross-section of the invention with the whirlpool operating.
Figure 4:
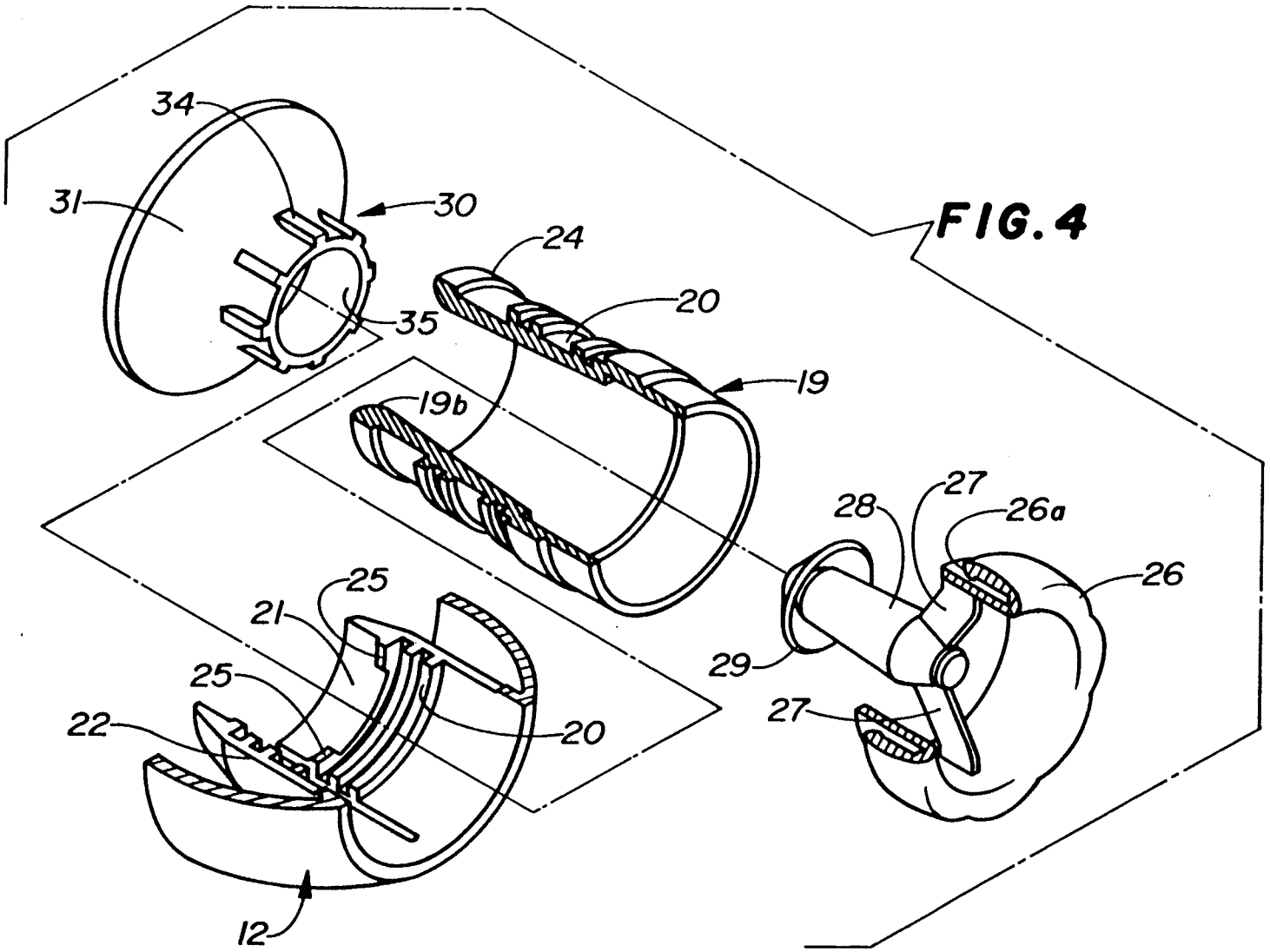
FIG. 4 is a blow-up of the sections of some of the parts in the body in the structure.

With reference to the above FIGS. 1,2 and 4, 1 illustrates the overall structure which can be fitted to the wall 2 of a bathtub by means of the ring nut 3 screwed on the same and consisting of the pipe 1*a* fitted at the bottom which connects to a supply pipe of water under pressure, not illustrated in the figures, and the top pipe fitting 1*b* having a closed cap 4 which prevents direct contact of said pipe fitting with the atmosphere but allows the same to communicate with air supply pipe 5 which originates from an adjustable room air intake, not shown in the figure.

6 illustrates a body which can be rotated in a section of space within the structure 1 delimited also by cover 7, which is screwed to the ring nut 3 in order to remove said body when necessary for maintenance; the gaskets 8 and 9 prevent unwanted water leaks, as described more fully in the operating description.

Before continuing with the detailed description of body 6, it is important to mention the screen 10 fixed on to the ring nut 3 with gasket 10a, which customizes the jet. As far as the body 6 is concerned, the same consists of two hollow hemispherical covers, namely a cover 11 turned towards the exterior of the bathtub and a cover 12 turned towards the interior of the bathtub, connected reciprocally by means of clip appendixes 13 formed in a single block, suitably spaced, from cover 11, in order to fix by elastic deformation into corresponding housings in cover 12 close to the tabs 12*a* whose purpose is to reduce the tangential component of the water flow entering the body 6; the length of said appendixes being such as to create a peripheral flow space 14 between the covers.

Cover 11 has a centre space 15, and an important feature of the invention is that the housing of body 6 within the structure 1 is realized so that the interior of the body communicates at the level of the peripheral space 14, by means of a section of space 16, with the water supply pipe 1*a*, and at the level of the centre space 15 of cover 11 by means of the section of space 17, with the air pipe fitting 1*b*.

Cover 12 has a output pipe of the air-water jet indicated as a whole with 18, which includes the cylindrical element 19 joined by means of threading 20 with an appendix of the cover 12 realized in four sections 21, 22 and 23. (The fourth section is not shown in FIGS. 1 and 4 and is unnumbered.) The structure allows an elastic deformation to block said element 19 as a result of the peripheral projection 24 of the same striking against teeth 25 obtained from said sections; the gasket 19*a* prevents unwanted water leaks.

The exterior end of the cylindrical element 19 has the ring nut 26 blocked by elastic deformation by means of the tooth 26*a*, which not only gives the jet a high quality appearance but also supports the pipe fitting 18 in a coaxial position by means of the tabs 27, the rod 28 having an elongated shape in order to form a jet having no contractions when it exits the pipe 18 in that within the body 6 there is an elastically pliable mushroom shaped end 29 made of elastic material such as rubber.

Inside the body 6, namely in the cover 11, there is a valve consisting of a rotating solid according to a curved wall, and positioned so as to provide a contact on its external concave surface 31 with the water and on its internal convex surface 32 with the air, as will be illustrated in the operating description.

Said valve which is in sliding contact on the periphery with the cylindrical surface of the guide 33 in the cover with radial tabs 34 so to provide a sliding contact with the internal surface of the pipe fitting 18 forming guide in the movements of the valve, has its curved wall open at the centre in hole 35 being substantially aligned with the centre space 15 of cover 11.

It should be noted that said curved wall is shaped to have a tangent on the periphery being substantially perpendicular to the axis of pipe fitting 18 and at the centre hole 35 being substantially parallel to said axis. Finally, 36 represents a spring fitted between the cover 11 and the valve 30, which pushes the same into a normally closed position, as shall be illustrated in the operating description, with the exterior concave surface 31 in contact with the end surface 19*b* of the cylindrical element 19 included in the output pipe fitting 18 of the jet, in order to stop the water flow, and with the internal surface of the hole 35 in contact with the end 29 of the rod 28, so as to stop the air flow.

The simultaneous contact of the above mentioned surfaces is ensured by the elastic pliability of the end 29, which also allows adaptations in the position of the valve 30 so as to ensure the complete contact between the surface 31 of said valve and the end surface 19*b* of the pipe fitting is which are shaped so as not to require seal gaskets and, according to an important feature of the invention, are shaped to form a pipe fitting between them for the water flow when the valve is open, and having gradually decreasing segments, at the front.

With reference to FIGS. 1 and 2, an operating description of the invention is provided.

FIG. 1 illustrates the situation which occurs when the bathtub is full of water, shown in the figure by the broken horizontal lines, and the system whirlpool pump is not operating: this is the situation which occurs when the bathtub is used as a normal bathtub, namely once the bathtub has been filled, as a preliminary condition before actually starting the whirlpool.

In this situation the action of the spring 36 on the valve 30 pushes the same into a double contact with the end surface 19*b* of the pipe fitting 18 and with the end terminal 29, so that thanks to all the above mentioned gaskets, water is prevented from flowing from the bathtub into the whirlpool system piping, thereby satisfying the essential objective of the invention.

When the whirlpool system pump is started, the situation illustrated in FIG. 2 occurs whereby the filiform broken line shows the water threads and the circles indicate the air.

The water which is supplied under pressure from the pipe 1*a* moves through the space 16 into the peripheral space 14 of the body 6 and contacts the exterior concave surface 31 of the valve 30, moving the same into an open position, and overcoming the action of the spring 36 thanks to three different reasons being firstly the pressure of the water, secondly the impulse deriving from the variation of the flow quantity consequent to the variation in the direction of the water speed , which from its position perpendicular to the axis of the output pipe fitting 18 moves into a position parallel to said axis, and finally the power due to the acceleration of the water mass inside the pipe which occurs in contact with the open valve 30 and which has, as mentioned previously, a gradually decreasing cross-section. For all these reasons, the possible oscillations in water pressure are not felt, as in the case of standard jets, and therefore there is no operating instability and vibrations of the valve which negatively affect the quality of the jet.

The movement of the valve 30 into the position illustrated in FIG. 2 not only causes the water pipe to open between the external surface 31 of the valve and the end surface 19*b* of the pipe 18, but also opens a pipe fitted between the surface of the hole 35 at the centre of the valve and the end piece 29, so that through this pipe by a Venturi effect determined by the incoming water speed the air is drawn by line 5 by means of the pipe fitting 1*b*, the section of space 17 and the input space 15 in the cover 11. The mixing of the two fluids occurring with the entry of the air in the central area of the pipe 18, creates a jet of water-air escaping from said pipe in which the air is broken into very small bubbles which are perfectly trapped in the water mass and which will therefore be held within the jet until this strikes the skin of the user, thereby creating an efficient massaging and oxygenating action.

It should be noted that the breaking up of the air and trapping of the same within the jet is considerably increased by radial tabs 34 on the wall 31 of the valve 30 which not only guide the valve during its movements, but also divide the incoming water current into very fast jets which, with respect to the annular shaped jet which would be created without these tabs, have a greater surface area, major turbulence and are less compact, thereby creating ideal conditions for trapping the air.

When the whirlpool system pump stops, water is no longer supplied under pressure on the valve 30 which is immediately taken by the spring 36 into its closed position, and thanks to the shape of the jets which are designed with the water pipe in the lowest area and the fact that there is free access towards the pipe of all the areas occupied by the water before the sections which are to be blocked by said valve, it is possible to drain all the water in the jets and in the whirlpool system piping when the bathtub is emptied at the end of the cycle, with no backwater being formed which could lead to pollution as described above.

Figure 3:
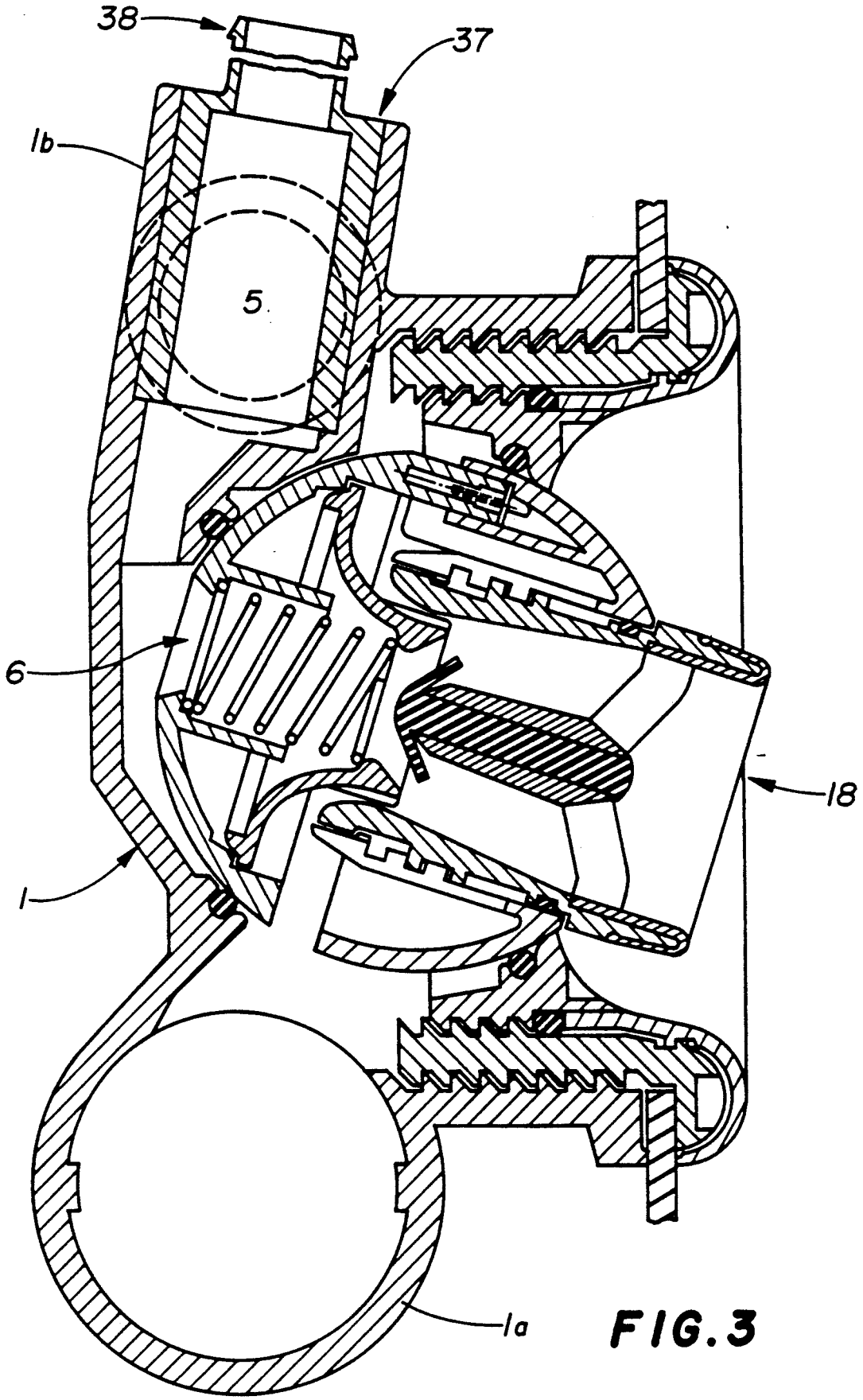
FIG. 3 is a cross-section of the invention showing a variant on the air supply fitting, with the body inside the structure rotated with respect to the position shown in the previous figures.

With reference to FIG. 3, an alternative version of the invention is described; it can be noted from the jet illustrated in this figure, that its structure 1 is unchanged and that it has the same pipe 1*a* and pipe fitting 1*b* and the body 6 and all its components are the same; regarding said body 6, the figure illustrates that the same can be rotated in a different way with respect to FIGS. 1 and 2, in order to allow different directions of the jet projecting from pipe fitting 18.

The version involves the air pipe 1*b* in which there is a cap with holes 37 having a pipe 38 communicating with the atmosphere, whose length blocks the mouthpiece of the pipe fitting 1*b* of the air supply line 5.

In this way the jet is supplied with air autonomously, and not in series with the other system jets as when for example the pipe fitting 1*b* has a closed cap 4, which makes it possible to extend the use of the whirlpool with non standard functions.

It is common knowledge that the exclusion of the air from the flow supplied from the jet reduces the massaging effect of the jet as a result of a reduction in speed consequent to its decrease in volume with the same outlet cross-section.

By programming for example an opening and closing cycle of the pipe 38 by means of an electrovalve fitted on the same, it is possible, thanks to the small quantities of air in question which only slightly reduce the response, to produce an intermitting intensity cycle of the massaging effect of the jet; this feature may be exploited in various ways for therapeutic purposes by varying the connections between the operating cycles and the jets.

It follows from the above that the invention satisfactorily meets all the scopes proposed: the same in fact ensures the an hermetic seal of the bathtub when the whirlpool is not operating as well as the complete drainage of the water in the piping of the whirlpool system at the end of the cycle so as to guarantee total hygiene.

The invention is also very efficient in terms of operation since the jet it produces can hold, as it penetrates the water mass, all the air mixed in the same until the jet reaches the skin of the user, who will consequently have the best massaging and oxygenating action; in addition non standard functions can be realized for therapeutic purposes and it offers operating stability with no oscillations and vibrations, and finally it has the possibility of adjusting the jet in different directions.

The jet is extremely compact, with a consequent reduction in the overall sizes which is extremely important because it increases installation possibilities of the whirlpool system in the case of difficult conditions, as well as ensuring easy assembly and disassembly of the jet as a whole and of its components. The invention in question can be produced with many modifications and in many embodiments, all of which are included in the invention conception: for example the valve 30 can consist of a conical shaped centre projection and the rod 28 can be supported at the axis of the pipe 18 in any way whatsoever, just as the end piece can be realized in any way.

In the practical realization of the invention, all the parts can be replaced with other similar technical components; in addition the material used, as well as the shapes and sizes can be modified according to specific requirements.

Figure 5:
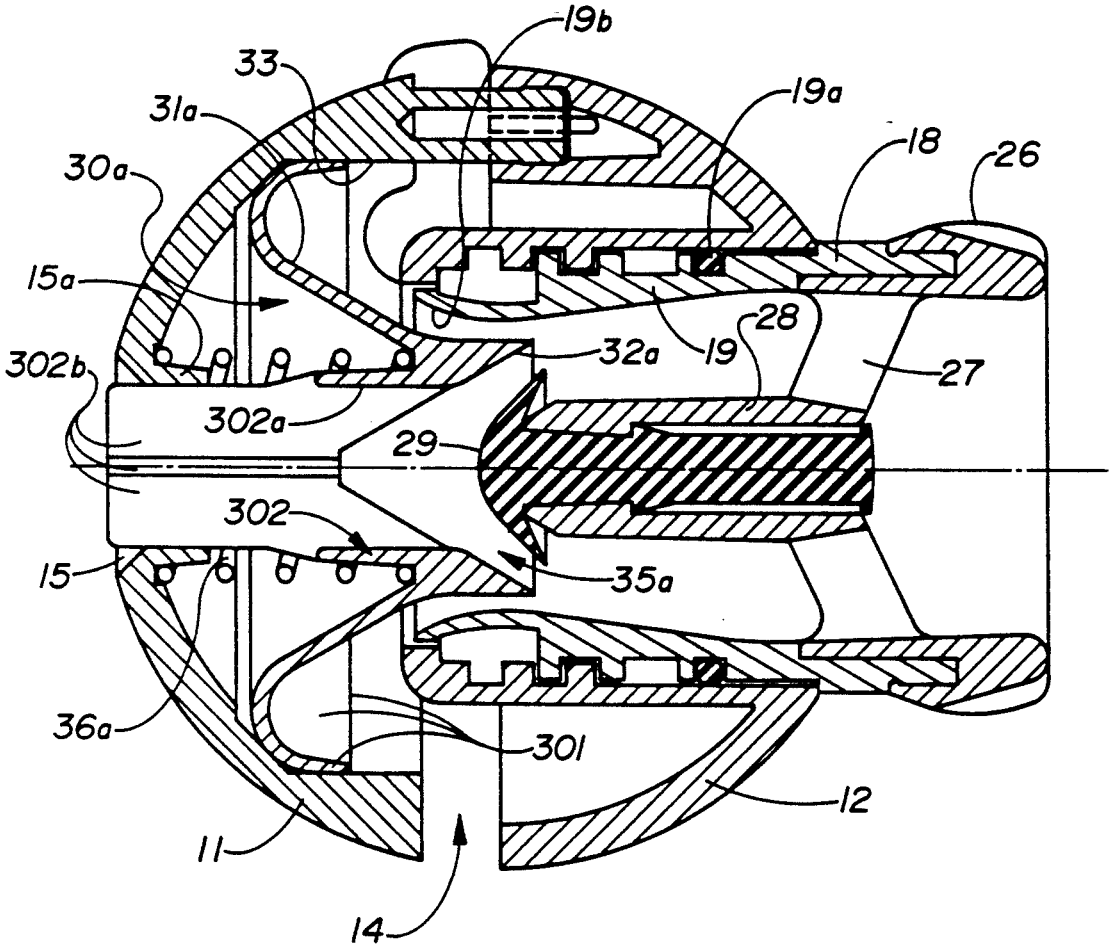
FIG. 5 illustrates an alternative embodiment of the above valve, placed in the hemispherical covers.

In this prospective and with reference to FIG. 5, an alternative construction embodiment of the valve (30) is now described.

The overall structure of the two opposing hemispherical covers (11 and 12) and that of the piping (18) being unchanged, with respect to valve (30), the valve (30*a*) illustrated in FIG. 5 has a number of small differences regarding the shape of its wall and the position of the centering and guide tabs with respect to the piping (18).

In particular the valve (30*a*) is a hollow truncated cone which ends on its wider base with an external thinned lip (301), bent into a "U" shape, which touches the cylindrical surface (33) in the interior of the cover (11).

The external surface of the truncated cone is marked in FIG. 5 with the number (31*a*).

This lip (301) has a thinned profile in order to provide a certain flexibility which allows it, when the water is placed under pressure by the whirlpool system pump, to widen and abut against the cylindrical surface (33), acting like a standard lip seal which holds against the relevant sliding surface.

The inside of the valve (30*a*) has a cylindrical collar (302) whose interior surface (302*a*) joins with that (32*a*) of the hole (35*a*) aligned with the centre space (15) of the cover (11).

Inside the collar (302) there are four rigid tabs positioned in the shape of a cross (302*b*) which fit and slide in a cylindrical collar (15*a*) inside the centre space (15) of the cover (11).

These tabs (302*b*) act as guiding and centering elements for the valve (30*a*) during its alternating runs, as it opens and closes, inside the cover (11).

In this construction embodiment, the return spring (36*a*) of the valve (30*a*) is fitted externally to the above two cylindrical collars (15*a*) and (302), which are aligned and coaxial.

With reference to FIG. 5, another construction variation made to cover (12) is underlined, which is simplified thanks to the fact that its appendix does not consist of four sections (21, 22 and 23) with stop teeth (25) for the peripheral projection (24) of the cylindrical element (19). Accidental unscrewing of the piping (18) can in fact be prevented thanks to the friction provided by the gasket (19*a*) so that the teeth (25) can be eliminated, with a consequent simplification of the profile as well as of the above appendix of the cover (12), which no longer needs to be realized in peripheral sections.

I claim:

1. A whirlpool jet which can be fixed to a bathtub having a wall, a bottom, an interior and an exterior and fitted with supply pipes for water and air under pressure, the whirlpool jet consisting of a valve (30 or 30*a*) having an external surface and a central projection, the external surface (31 or 31*a*) being washed by water, the valve further having an open central air flow hole (35 or 35*a*), the valve being pushed by a spring (36 or 36*a*) into a normally closed position, the external surface of the valve being in contact with an end of a water-air flow pipe (18), and the central air flow hole (35 or 35*a*) being in contact with an end (29) of a rod (28), the rod being fitted on an axis of said pipe.

2. A whirlpool jet according to claim 1, wherein the valve (30) is a hollow truncated cone having a concave external surface.

3. A whirlpool jet according to claim 1, including:

a structure (1) which can be fixed to the wall (2) of the bathtub including a bottom pipe (1*a*) connected to the water supply line under pressure and a top pipe fitting (1*b*) selectively communicating with the air supply pipe and directly to the atmosphere;

a body (6) including two hollow hemispherical covers (11 and 12) the one cover (11) oriented toward the exterior of the bathtub and the other cover (12) oriented toward the interior of the bathtub, the covers being reciprocally connected so as to form therebetween a peripheral space (14), a pipe (18) disposed on an axis in the other cover (12), the pipe (18) being oriented towards the interior of the bathtub, the pipe (18) supplying the jet of air-water, a rod (28) disposed on the axis of the pipe (18), a centre space 915) disposed in the one cover (11), the centre space (15) being oriented toward, the exterior of the bathtub, said body being housed so that the same may rotate within said structure (1) whereby the peripheral space (14) between the covers communicates with the water supply pipe (1*a*), and the centre space (15) in the one cover (11) communicates with the air supply pipe (1*b*);

the valve (30) having an external concave surface and an internal convex surface, the valve being disposed in the one cover (11) oriented toward the exterior of the bathtub, the concave surface (31) communicating with the water and the convex surface (32) communicating with the air, the central air flow hole (35) being substantially aligned with the centre space (15) in the one cover (11), the spring (36) between the one cover (11) and the valve (30) disposed to push the valve into a normally closed position, wherein the concave external surface (31) is in contact with the end of the flow pipe (18) in the other cover (12) in order to stop the water flow and the central air flow hole (35) being in contact with the end (29) of the rod (28) fitted in said pipe, so as to stop the air flow.

4. A whirlpool jet according to claim 3, further comprising the centre space (15) having an internal collar (15*a*) formed therein, the valve (30*a*) being a hollow truncated cone having a wider base and a narrower base, the wider base having a thinned exterior lip (301) bent into a "U" shape, the narrower base having an internal cylindrical collar (302) having an internal hole (35*a*) therein, and an exterior surface, said internal hole being aligned with the centre space (15) of the one cover (11) where the valve (30*a*) is positioned; the spring (36*a*) being fitted between the exterior surface of said internal cylindrical collar (302) and the internal collar (15*a*) on the centre space (15), wherein the valve (30*a*) is urged into a normally closed position with the external surface of the valve (31*a*) in contact with the end of the water-air flow pipe (18) in the other cover (12), so as to stop the water flow and with the terminal end (29) of the rod (28) being received in the central air-flow hole (35*a*) so as to stop the air flow.

5. A whirlpool jet according to claim 1, wherein the end (29) of the rod (28) in contact with the central air-flow hole (35 or 35*a*) of the valve (30 or 30*a*) is elastically pliable.

6. A whirlpool jet according to claim 3, further comprising a ring nut (3) threaded to the structure (1) of the whirlpool jet in order to fix the same to the wall (2) of the bathtub, said ring nut (3) having a lid (7) threaded on the same, a first body gasket (3) disposed between the one cover (11) and the structure (1), a second body gasket (9) disposed between the other cover (12) and the lid (7), a threaded screen (10) being fixed on the ring nut (3), the threaded screen (10) facing the interior of the bathtub.

7. A whirlpool jet according to claim 3, further comprising a closed cap (4) joined to the top pipe fitting (1*b*) in the jet structure so as to prevent any direct communication of the same with the atmosphere, the closed cap (4) communicating with the air supply pipe (5).

8. A whirlpool jet according to claim 3, further comprising a cap with holes (37) joined to the top pipe fitting (1*b*) in the jet structure so as to prevent communication with the air supply pipe (5), and providing direct communication of the whirlpool jet with the atmosphere.

9. A whirlpool jet according to claim 1, characterized in that the two hemispherical covers (11 and 12) are reciprocally connected by means of clip appendixes (13) derived from the one cover and which fit and block by elastic deformation on the other cover, said appendixes having a sufficient length to create between the covers, the peripheral space (14) in the required dimensions.

10. A whirlpool jet according to claim 1, wherein the valve (30) slides against a cylindrical guide surface (33) in the one cover (11) facing the exterior of the bathtub, a plurality of radial tabs (34) being formed on the external surface of the valve (30) near to the central air-flow hole (35), the valve (30) sliding against an interior surface of the water-air flow pipe (18).

11. A whirlpool jet according to claim 4, wherein the valve (30*a*), by means of its lip (301), slides against a cylindrical surface of a guide (33) in the one cover (11), the internal cylindrical collar (302) having a plurality of tabs (302*b*) formed thereon, said tabs fitting and sliding within the internal collar (15*a*).

12. A whirlpool jet according to claim 1, wherein the external surface of the valve (30) peripherally has a tangent which is substantially perpendicular to the axis of the water-air flow pipe (18) and substantially parallel to an axis on the central air flow hole (35).

13. A whirlpool jet according to claim 1, wherein the end of the water-air flow pipe (18) facing the interior of the cover (12) has an interior surface (19*b*) which has a cross section, the cross section being progressively decreasing toward the valve (30 or 30*a*) such that when the valve is open, water flows between the end of the water-air flow pipe and the valve.

14. A whirlpool jet according to claim 3, further comprising the water-air flow pipe (18) having a cylindrical element (19) threadably connected to an appendix facing the other cover (12) and oriented toward the interior of the bathtub, the cylindrical element (19) having a first end and a second end, the appendix having a plurality of sections formed therein, each section having at least two teeth formed therein in order to provide an elastic deformation to block the cylindrical element (19), wherein a peripheral projection (24) on the first end of the cylindrical element strikes against the teeth (25), the second end of said cylindrical element engaging a ring nut (26) and being blocked by elastic deformation.

15. A whirlpool jet according to claim 1 characterized in that the rod (28) on the axis of the water-air flow pipe has a mushroom shaped elongated end (29) made of rubber which is elastically pliable, the rod (28) having an opposite end terminating with tabs (27), the tabs connecting to a ring nut (26).

* * * * *